US009531105B2

(12) United States Patent
Wimmer et al.

(10) Patent No.: US 9,531,105 B2
(45) Date of Patent: Dec. 27, 2016

(54) CONNECTOR AND MATING CONNECTOR

(71) Applicant: Lisa Draexlmaier GmbH, Vilsbiburg (DE)

(72) Inventors: Stefan Wimmer, Hohenthann (DE); Christian Wimmer, Gerzen (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 0 days.

(21) Appl. No.: 14/554,176

(22) Filed: Nov. 26, 2014

(65) Prior Publication Data

US 2015/0147917 A1 May 28, 2015

(30) Foreign Application Priority Data

Nov. 28, 2013 (DE) ..... 10 2013 019 873

(51) Int. Cl.
*H01R 13/04* (2006.01)
*H01R 13/436* (2006.01)
*H01R 13/428* (2006.01)

(52) U.S. Cl.
CPC ..... *H01R 13/4362* (2013.01); *H01R 13/428* (2013.01)

(58) Field of Classification Search
CPC . H01R 13/432; H01R 13/428; H01R 13/4362; H01R 2201/26
USPC ..... 439/595, 733.1, 626, 871
See application file for complete search history.

(56) References Cited

U.S. PATENT DOCUMENTS

| | | | | |
|---|---|---|---|---|
| 7,351,117 | B1 * | 4/2008 | Mostoller | H01R 13/428 439/744 |
| 8,956,192 | B2 * | 2/2015 | Eckel | H01R 13/44 439/686 |
| 2009/0318022 | A1 | 12/2009 | Simmel et al. | |
| 2013/0143448 | A1 * | 6/2013 | Eckel | H01R 13/44 439/686 |
| 2015/0147902 | A1 * | 5/2015 | Wimmer | H01R 13/428 439/357 |
| 2015/0147917 | A1 * | 5/2015 | Wimmer | H01R 13/4362 439/692 |
| 2015/0232055 | A1 * | 8/2015 | Gunreben | B60R 21/20 280/728.2 |

FOREIGN PATENT DOCUMENTS

| | | | | |
|---|---|---|---|---|
| DE | 9416540 | U1 | 2/1996 | |
| DE | 19961591 | A1 | 6/2001 | |
| DE | 102006038535 | A1 | 2/2008 | |
| JP | 11260455 | A * | 9/1999 | |
| JP | 5328388 | B2 * | 10/2013 | |
| WO | WO 2006099007 | A1 * | 9/2006 | H01R 13/62955 |

* cited by examiner

*Primary Examiner* — Abdullah Riyami
*Assistant Examiner* — Nader Alhawamdeh
(74) *Attorney, Agent, or Firm* — Finnegan, Henderson, Farabow, Garrett & Dunner LLP

(57) ABSTRACT

An electrical connector is configured to be electrically coupled to a mating connector, The connector includes a housing having a contact chamber, and a contact connector element accommodated in the contact chamber. The contact connector element is configured to be coupled to a mating connector element of the mating connector and includes a primary locking member configured to latch with the contact chamber. The connector further includes a secondary locking member configured to frictionally lock the contact connector element in the housing.

17 Claims, 10 Drawing Sheets

CONNECTOR AND MATING CONNECTOR

CROSS-REFERENCE TO RELATED APPLICATION

This application is based upon and claims the benefit of prior German Application No. 10 2013 019 873.9, filed on Nov. 28, 2013, the entire contents of which are incorporated herein by reference.

TECHNICAL FIELD

The disclosure relates to a connector and a mating connector for the electrical connection of a contact connector element of the connector and a mating contact connector element of the mating connector.

BACKGROUND

In the automotive sector, especially to transmit high currents, connectors are often used, which have contact chambers into which suitable contact connector elements are inserted, which are doubly locked in the housing by means of a primary and a secondary locking members. For example, a primary locking can be achieved via latching arms of the contact connector elements, which latch behind protrusions in the contact chamber. Furthermore, the connector has a secondary locking member, which accommodates the contact connector element in the housing when the primary locking element releases.

However, despite the double locking, the contact connector elements can move in the contact chambers so that vibrations of the vehicle, which are created regularly during travel, lead to a friction between the contact connector element and the mating connector element. This creates wear and tear on the contact connector element and the mating connector element, specifically where they are electrically connected, and therefore a transition resistance between the contact connector element and the mating connector element increases. On the one hand, the increased transition resistance can cause the contact connector element and the mating contact connector element to be no longer connected electrically. On the other hand, the increased transition resistance may also cause heating, especially at high currents, which damages the connector and/or mating connector and, in extreme cases, even causes a fire. Consequently, a vehicle may break down and cannot continue to travel, especially if the problem with the connector connection relates to a function that is critical for driving.

SUMMARY

One object of the disclosure is to provide a connector for the electrical connection of a contact connector element of the connector and a mating contact connector element of a mating connector, which guarantees a dependable electrical connection and has a longer service life compared to conventional connectors. Another object is to provide an advantageous mating connector for the connector according to the disclosure.

These objects are achieved with a connector and a mating connector consistent with embodiments of the disclosure.

According to the disclosure, there is provided a connector for the electrical connection of a contact connector element of the connector and a mating connector element of a mating connector. The connector has a housing with a contact chamber to accommodate a contact connector element and a secondary locking member for the secondary locking member of the contact connector element in the housing. According to the disclosure, the secondary locking member is set up to frictionally lock the contact connector element in the housing.

Because of the frictional connection, the contact connector element has little play in the housing, and therefore vibrations of the connector do not lead to a movement of the contact connector element in the housing. Accordingly, friction between the contact connector element and the mating connector element is reduced or eliminated. As a result, wear and tear is eliminated or at least reduced to a minimum.

The contact connector element can include a metal sheet, which is bent to essentially create a building block with two main surfaces, which in the following are referred to as side walls. In addition to the main surfaces, the contact connector element can also have two smaller side surfaces. The contact connector element has a front face in a connecting direction of the contact connector element. Opposite the connecting direction, there can be a contact plate at the contact connector element, to which a cable can be attached. In one embodiment, the contact connector element has lamellae inside the bent metal sheet, between which a mating contact connector element is guided to slightly deform the lamellae, and the lamellae resiliently accommodate the mating contact connector element. At the side walls, latching arms can be provided, which are to latch behind protrusions in the contact chamber so as to effect an easy primary locking. Furthermore, there can be tabs on the side walls, which, for example, allow a shape-fitting locking of the contact connector element. The contact connector element can be a Lear Corporation MAK connector, for example.

In one embodiment, the secondary locking member has a ramp which is arranged so that when closing the secondary locking member, the ramp presses against a side wall of the contact connector element and thus presses an additional side wall of the contact connector element against the housing, which creates a frictional connection between the contact connector element and the housing. In this manner, a more robust frictional connection can be created between the contact connector element and the housing in a simple and effective manner. The ramp can have an incline of 0.1 to 10 degrees, for example. In some embodiments, the incline of the ramp is between 3 and 5 degrees.

In one embodiment, the secondary locking member is additionally established to lock the contact connector element in the housing with a shape-fitting connection. This leads to a more secure interlocking.

The secondary locking member can have a locking element, for example, which is arranged so that the locking element is moved under a protrusion, in particular a tab, of the contact connector element when the secondary locking member is closed and thus, together with the protrusion, creates a shape-fitting connection against a connecting direction of the connector. In some embodiments, the aforementioned protrusion is on the side wall of the contact connector element.

The locking element can comprise a slope, which slides under the protrusion, in particular the tab, of the contact connector element when the secondary locking member is closed, and presses a front face of the contact connector element against the housing. This further restricts the movement of the contact connector element in the housing and therefore further minimizes wear and tear due to vibrations. The slope can have an incline of 0.1 to 10 degrees, or, in some embodiments, between 3 and 5 degrees.

In some embodiments, the secondary locking member has a detent latch, and the housing has a pre-locking groove and a final-locking groove, with the detent latch engaging in the pre-locking groove when the secondary locking member is in a pre-locking position, and engaging in the final-locking groove when the secondary locking member is in a final-locking position. In the pre-locking position, the secondary locking member is already fastened in the housing, but the contact connector element can still be inserted into the housing and removed from the housing. In the final-locking position, a contact connector element located in the housing is locked in the housing in such a way that it can no longer be removed from the housing as long as the secondary locking member remains in the final-locking position.

The housing can have a plurality of contact chambers to accommodate a plurality of contact connector elements, with secondary locking member in the housing, in particular by means of a single secondary locking member. Using a single secondary locking member results in savings of material and therefore cost, compared to using a plurality of secondary locking members.

If a plurality of contact chambers are provided, said contact chambers and the secondary locking member can be arranged in the housing in such a fashion that the secondary locking member can be inserted between the contact connector elements located in the contact chambers to press side walls of the contact connector elements against the housing. With this arrangement, it is therefore possible to take advantage of a stiffness of the secondary locking member to press side walls of the contact connector elements against the housing. In this manner, a frictional connection can be created between the contact connector elements and the housing in a particularly simple manner.

In some embodiments, the secondary locking member has a main body from which a manipulation element and a locking arm extend. In some embodiments, the manipulation element is supported by a reinforcing element, which is connected to the manipulation element and to the main body. The locking arm can be developed so that it comprises the ramp and/or the locking element, in particular the locking element with the slope. The manipulation element can protrude essentially perpendicularly from the main body. If the housing has a plurality of contact chambers, the secondary locking member can have a locking arm for each contact connector element. With the manipulation element, a user can move the secondary locking member in a simple fashion so that the secondary locking member can be moved into the final-locking position in a simple and convenient manner.

According the disclosure, there is also provided a mating connector for the electrical connection of a mating contact connector element of the mating connector and a contact connector element of a connector according to the invention. The mating connector can have a mating connector ramp, which, in some embodiments, is developed so that secondary locking member of the connector, which is not yet in final-locking position, slides along the mating connector ramp as the connector is being connected to the mating connector and thus is moved into the final-locking position. In this manner, the connector and the mating connector have a certain amount of play during the connecting process, which means that less connecting forces have to be expended.

For example, the mating connector ramp can be positioned relative to a connecting axis of the mating connector at an angle of 10 to 70 degrees, or, in some embodiments, 30 to 45 degrees. The angle range of 30 to 45 degrees allows an easy sliding of the secondary locking member along the mating connector ramp with simultaneous efficient use of the available construction space.

Additionally, the mating connector can have an accommodation means for a part of the secondary locking member of the connector, which secures the secondary locking member in its final-locking position when the connector and the mating connector are connected. The accommodation means can be a slot, for example, into which the manipulation element engages in the final-locking position. The accommodation means leads to a further improvement of the locking security.

In addition to the connector and the mating connector according to the disclosure, there is also provided an arrangement of a connector and a mating connector according to the disclosure.

DESCRIPTION OF THE EMBODIMENTS

In the following, until noted otherwise, elements that are identical and act identically are described with the same reference symbol.

Figure 1:
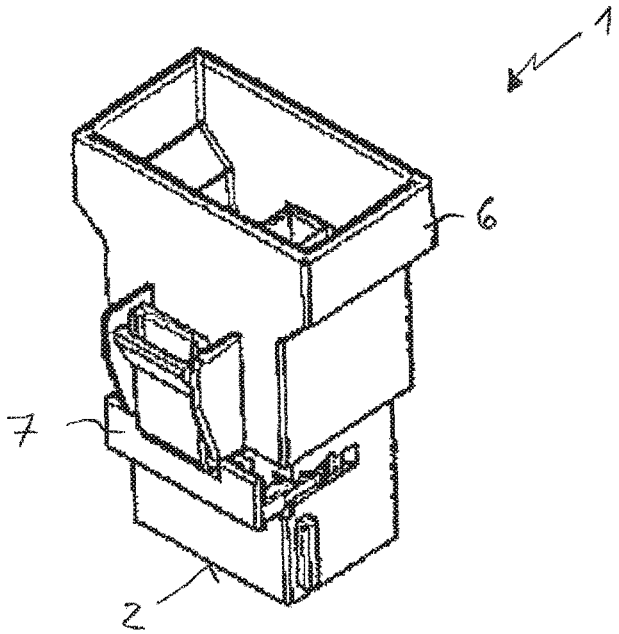
Fig. 1 (Prior Art)
FIG. 1 shows a conventional connector in a view diagonally from above.
Figure 2:
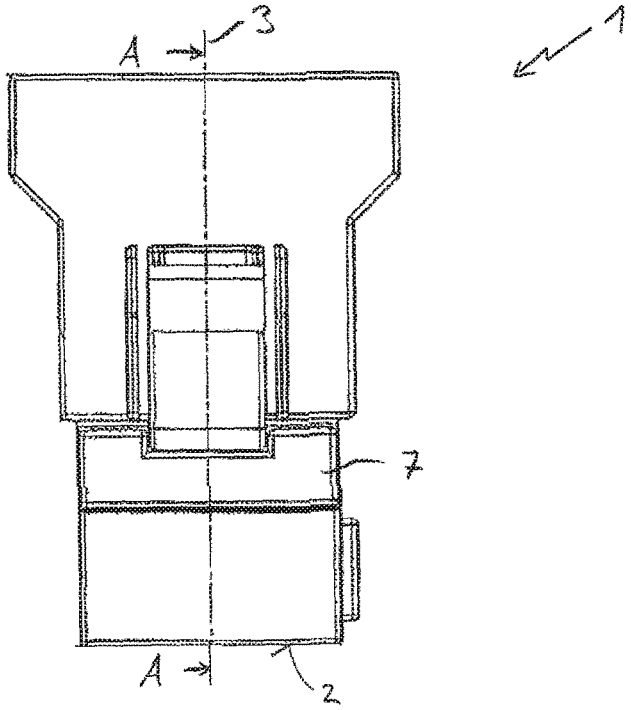
Fig. 2 (Prior Art)
FIG. 2 shows the connector in FIG. 1 in a lateral view.
Figure 3:
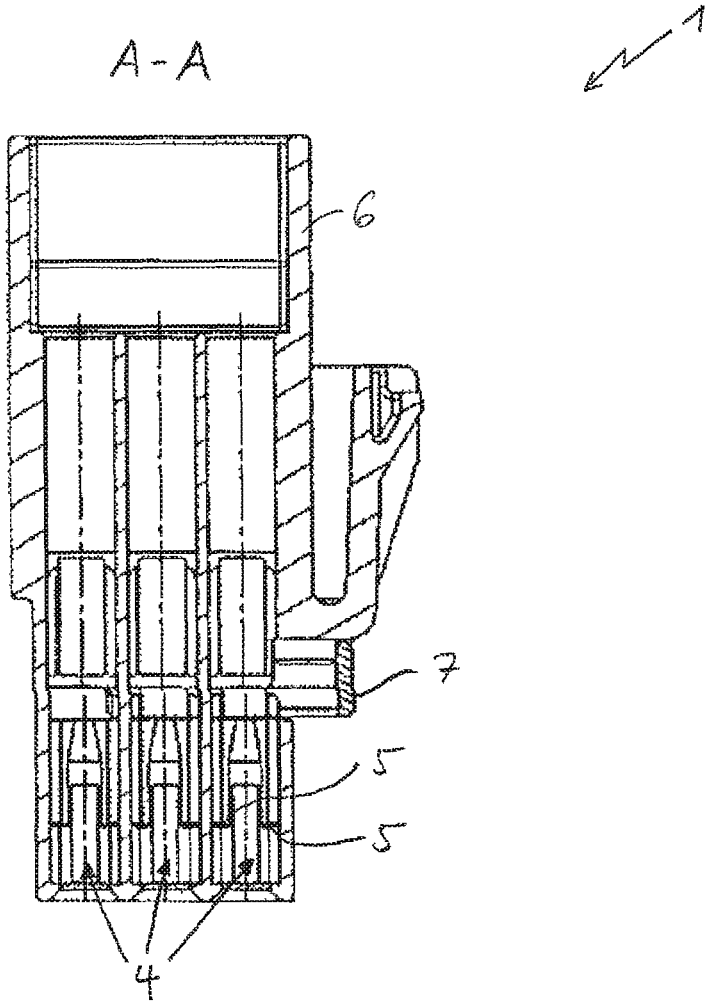
Fig. 3 (Prior Art)
FIG. 3 is a cross-sectional view of the connector in FIG. 2.
Figure 4:
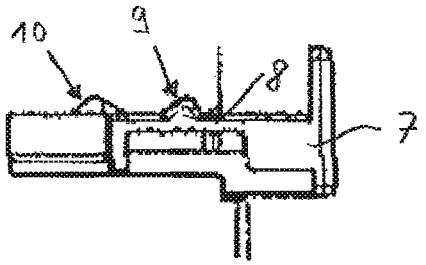
Fig. 4 (Prior Art)
FIG. 4 shows a secondary locking member of the connector in FIG. 1.
Figure 5:
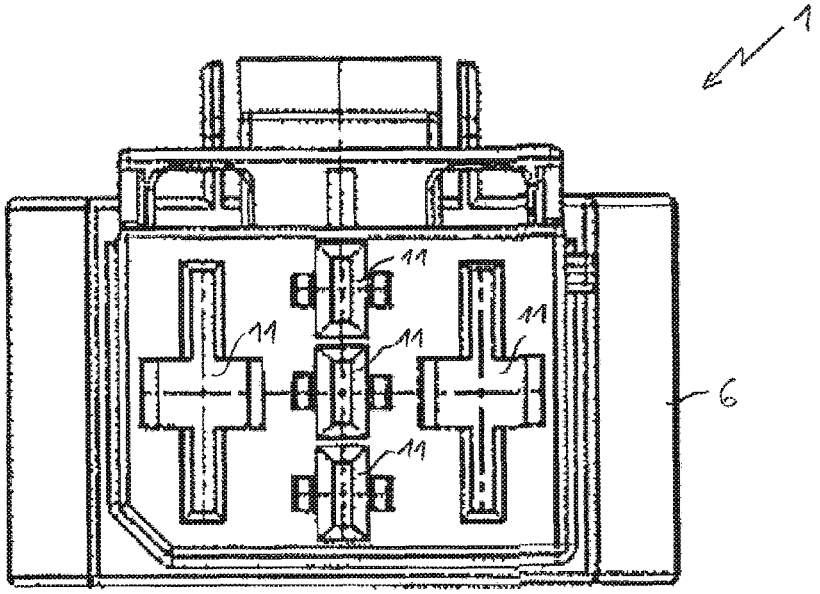
Fig. 5 (Prior Art)
FIG. 5 shows the connector in FIG. 1 in a view from below towards a face of the connector.
Figure 6:
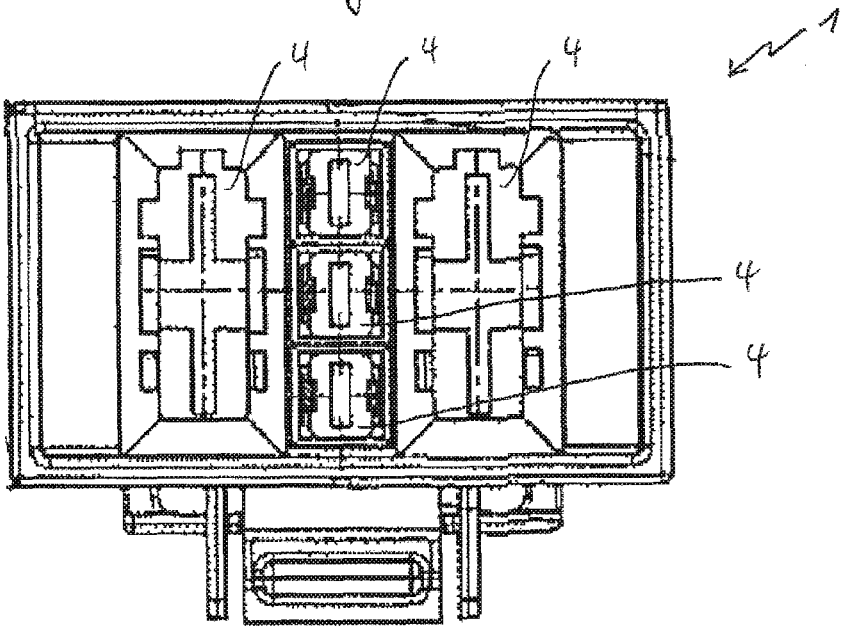
Fig. 6 (Prior Art)
FIG. 6 shows the connector in FIG. 1 in a view from top towards a cable outlet side.

FIGS. 1 to 6 illustrate a conventional connector 1. FIG. 1 shows the connector 1 in a perspective view diagonally from above. Below is a front face 2 of the connector 1, which is to be connected to a mating connector. FIG. 2 shows the connector 1 in a lateral view. FIG. 3 shows a cross-sectional view of the connector 1 cut along a section line 3 in FIG. 2 and viewed at a direction indicated by reference symbol A in FIG. 2. FIG. 3 shows contact chambers 4 into which contact connector elements can be inserted. The contact chambers 4 each have protrusions 5, behind which latching arms of the contact connector element latch to achieve a primary locking in a housing 6 of the connector 1. The connector 1 has an additional secondary locking member 7, for a secondary locking member of the contact connector elements in the housing 6. The same secondary locking member 7 is shown again in FIG. 4 in an enlarged view. The secondary locking member 7 has a detent latch 8, which is currently engaged in a pre-locking groove 9 of the housing 6. The housing 6 also has a final-locking groove 10. In FIG. 5, the connector 1 is shown again from below, e.g. with a view to the front face 2. Openings 11 in the housing 6, through which the mating contact connector elements are inserted to engage in this manner with the contact connector elements accommodated in the contact chambers 4 of the housing 6, are clearly visible. FIG. 6 again shows the connector 1 from above, e.g. with a view to a cable outlet side of the connector 1, thus rendering the contact chambers 4 clearly visible.

Figure 7:
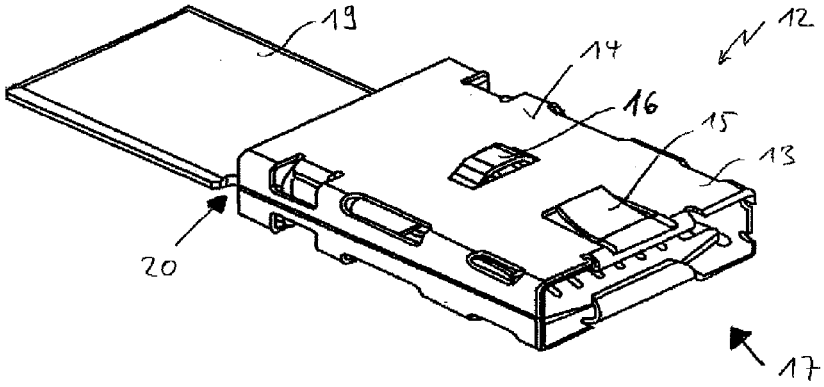
FIG. 7 shows a commercial contact connector element in a perspective view.
Figure 8:
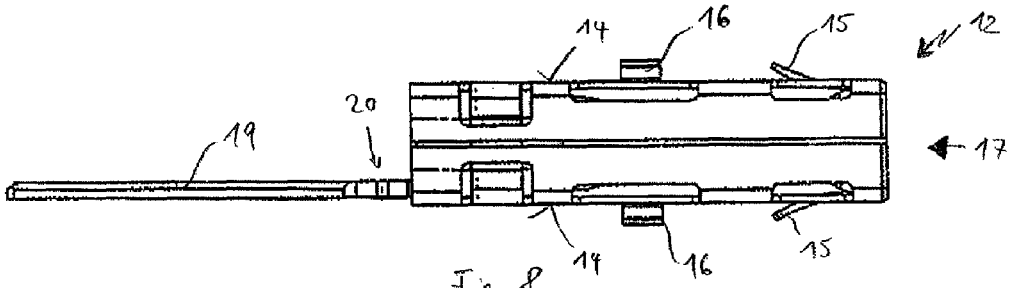
FIG. 8 shows the contact connector element in FIG. 7 in a lateral view.
Figure 9:
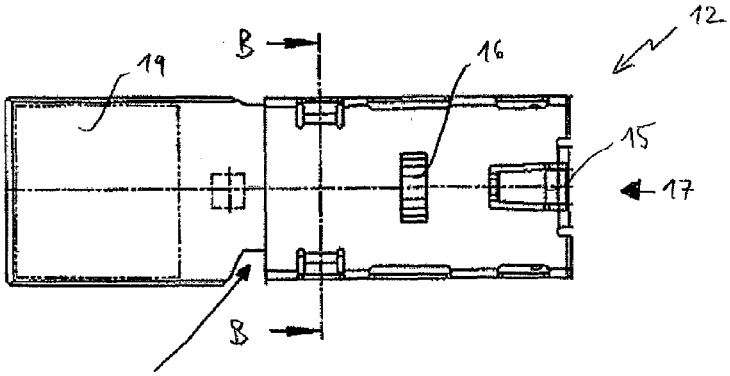
FIG. 9 shows the contact connector element in FIG. 7, in a view toward a side wall of the contact connector element.
Figure 10:
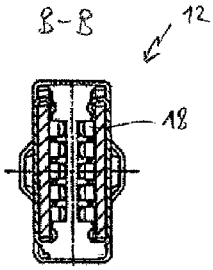
FIG. 10 is a cross-sectional view of the contact connector element in FIG. 7.

FIGS. 7 to 10 illustrate a commercial contact connector element 12. In FIG. 7, the contact connector element 12 is shown in a perspective view. FIG. 8 shows a view toward a small wall of the contact connector element 12. FIG. 9 shows a view toward a large side wall of the contact connector element 12. FIG. 10 shows the contact connector element 12 in a cross-sectional view along a line B-B drawn in FIG. 9. The contact connector element 12 includes a metal sheet 13, which is bent in such a fashion that it essentially forms a building block. This creates large side walls 14, each of which have a latching arm 15 and a tab 16. The latching arms 15 can latch behind the protrusions 5 of the connector 1. At a front face 17, a mating contact connector element can be inserted, which is held by means of lamellae 18 shown in FIG. 10. At a side of the metal sheet 13 opposite the front face 17, a contact plate 19 is attached, where a cable can be fastened, for example. FIG. 9 shows that the contact plate 19 has a recess 20 into which the secondary locking member 7 can engage for the secondary locking member of the contact connector element 12 in the housing 6. The secondary locking member 7 also provides a shape-fitting connection.

Figure 11:
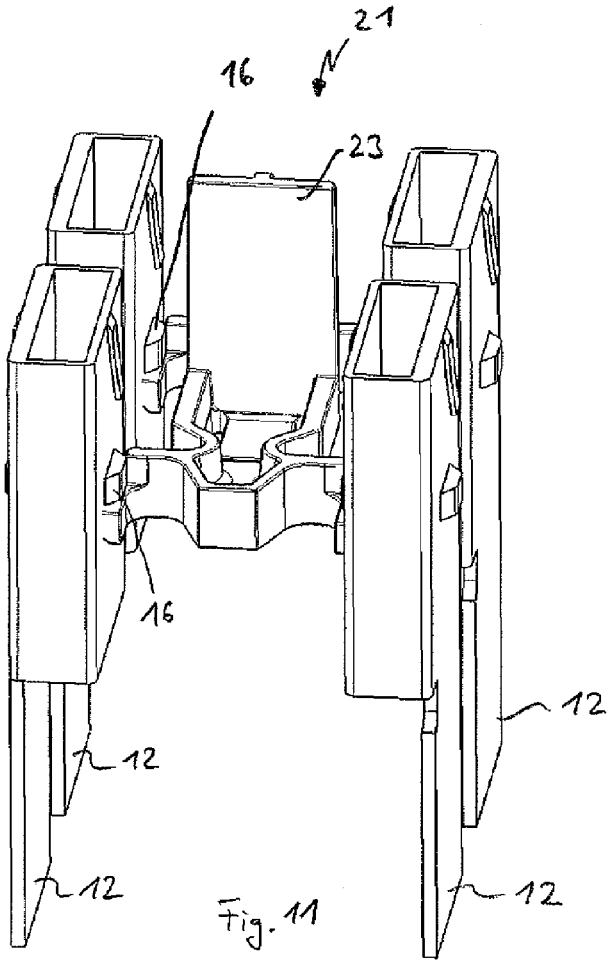
FIG. 11 shows a secondary locking member with contact connector elements according to an exemplary embodiment.
Figure 12:
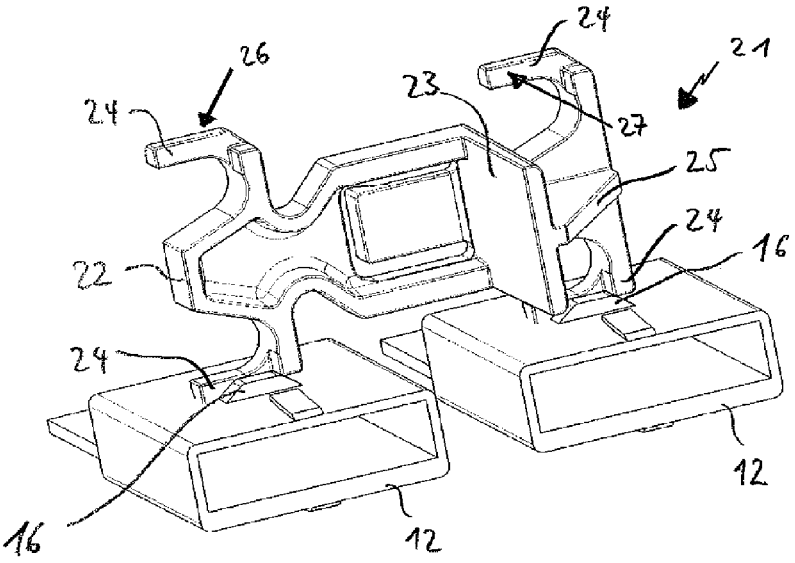
FIG. 12 shows the secondary locking member in FIG. 11, in a diagonal view from above.
Figure 13:
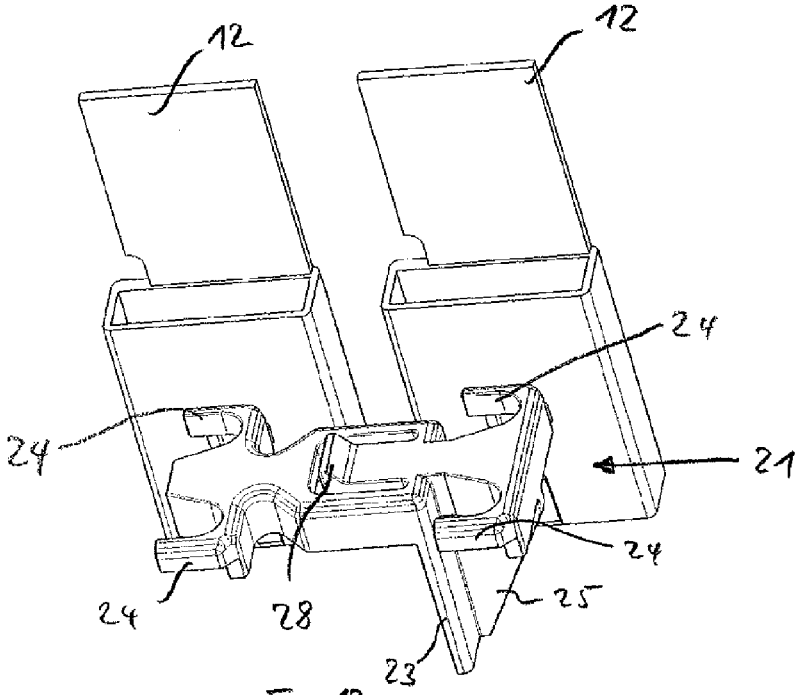
FIG. 13 shows the secondary locking member in FIG. 11, in a diagonal view from below.

FIGS. 11 to 13 illustrate an exemplary secondary locking member 21 according to the disclosure. The secondary locking member 21 is shown in FIG. 11 from the front; in FIG. 12 diagonally from above; and in FIG. 13 diagonally from below. The secondary locking member 21 has a main body 22, from which a manipulation element 23 and four locking arms 24 extend. The manipulation element 23 is supported by a reinforcing element 25, which is connected to the manipulation element 23 and the main body 22. As shown in FIG. 11, the secondary locking member 21 has a ramp 26 on a side of each locking arm 24. Each ramp 26 presses against a side wall 14 of the contact connector element 12 and therefore presses another side wall 14 of the contact connector element 12 against the housing (not shown). As illustrated in FIG. 11, the secondary locking member 21 is therefore slid between the contact connector elements 12 so that the contact connector elements 12 are pressed against the housing and a frictional connection is created between the contact connector elements 12 and the housing. The ramp 26 has an incline between 3 and 5 degrees and therefore the ramp 26 in FIG. 12 is difficult to discern because of the low incline. Furthermore, each of the locking arms 24 has an slope 27, which respectively slides under the tab 16 of the contact connector elements 12. Therefore, in the orientation of the secondary locking member 21 shown in FIG. 12, the slope 27 is at the top on the locking arms 24. As FIG. 13 shows particularly well, the secondary locking member 21 has a detent latch 28. The function of the detent latch 28 will be explained in the following with reference to FIG. 14.

Figure 14:
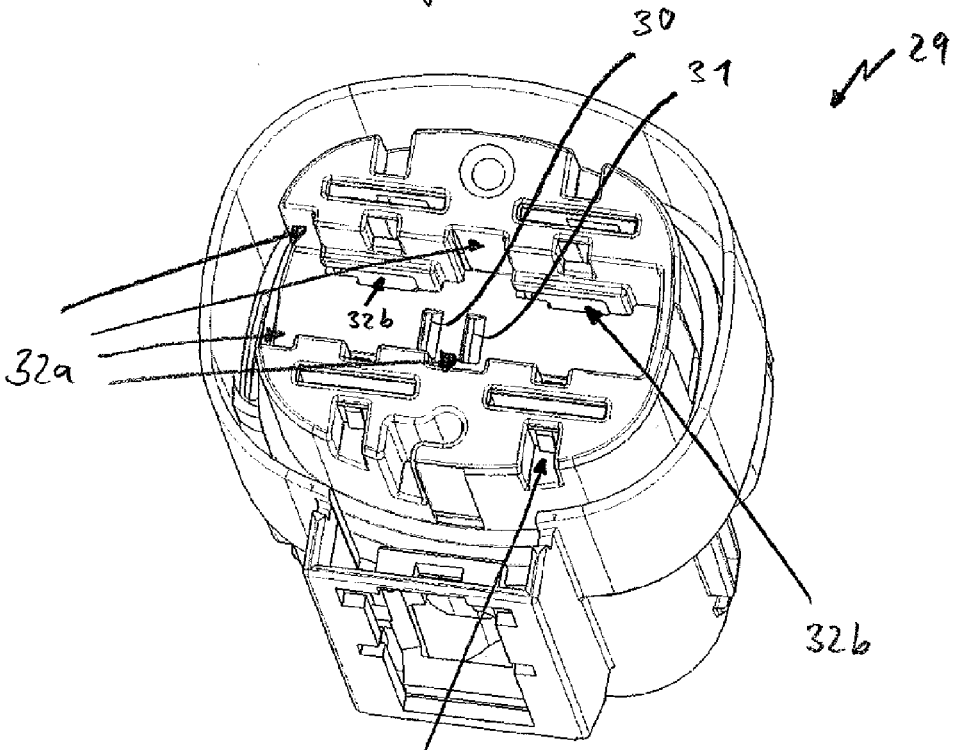
FIG. 14 shows a housing of a connector according to an exemplary embodiment.

FIG. 14 shows an exemplary housing 29 according to the disclosure. The housing 29 has a pre-locking groove 30 and a final-locking groove 31. If the secondary locking member 21 is in its pre-locking position, the detent latch 28 of the secondary locking member 21 engages in the pre-locking groove 30. On the other hand, if the secondary locking member 21 is in a final-locking position, the detent latch 28 latches into the final-locking groove 31.

Figure 15:
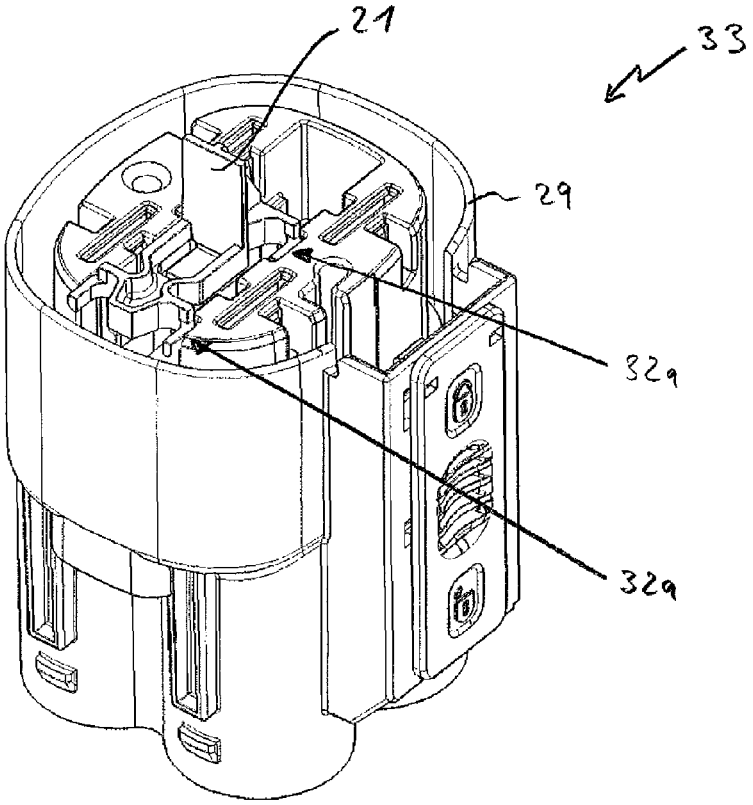
FIG. 15 shows the housing in FIG. 14 as a secondary locking member according to an exemplary embodiment is being inserted.
Figure 16:
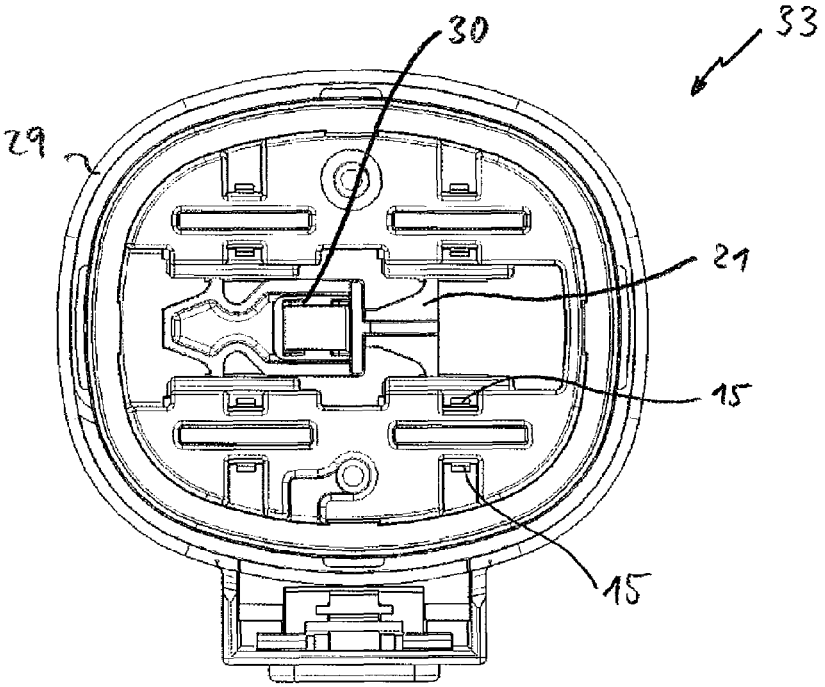
FIG. 16 shows a connector according to an exemplary embodiment with a secondary locking member in a pre-locking position.
Figure 17:
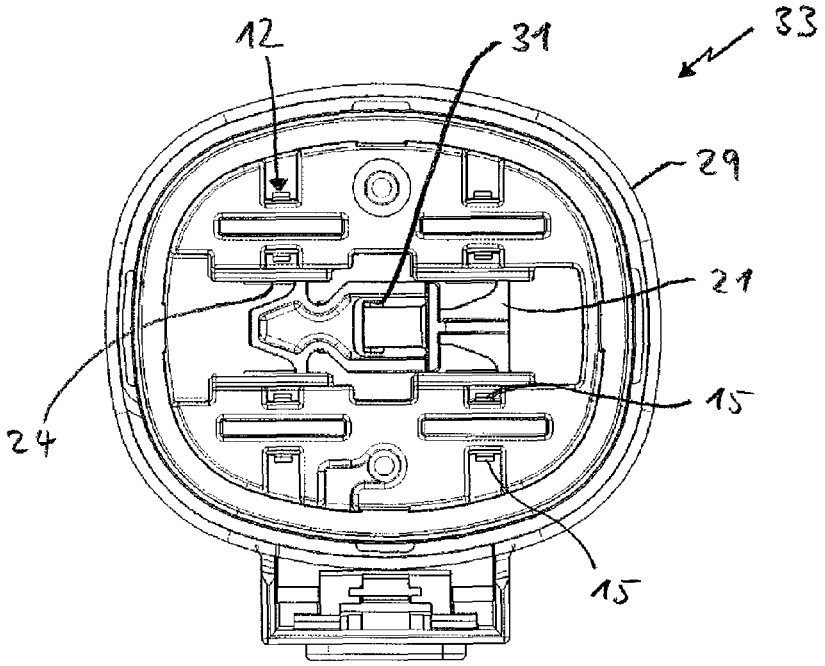
FIG. 17 shows the connector in FIG. 16 with the secondary locking member in a final-locking position.

FIG. 15 shows a connector 33 consistent with embodiments of the disclosure. The connector 33 includes the secondary locking member 21 inserted into the housing 29 via assembly guide rails 32*a*. As soon as the secondary locking member 21 has been inserted into the housing 29, it can be slid into its pre-locking position along the locking guide rails 32*b* in FIG. 14, as shown in FIG. 16. In FIG. 17, the connector 33 is shown again in the final-locking position of the secondary locking member 21. As shown there, the locking arms 24 are then at the level of the connector contact elements 12 with secondary locking member.

Figure 18:
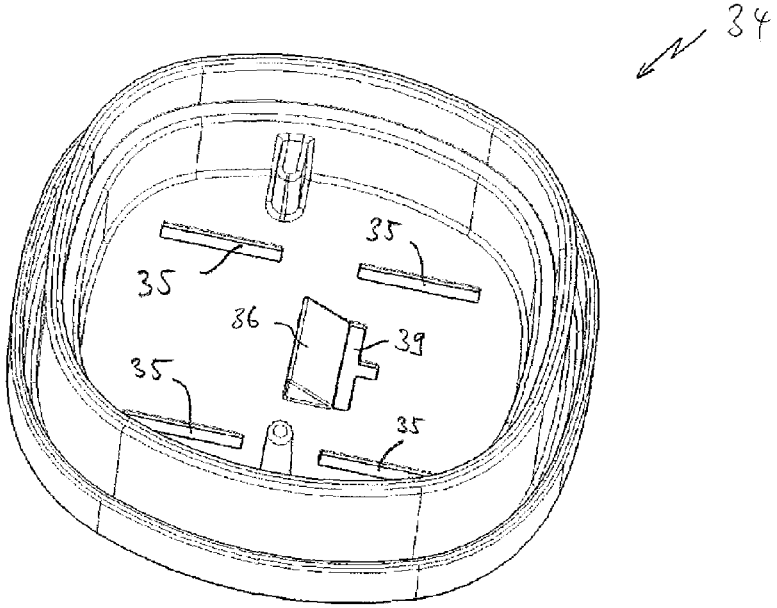
FIG. 18 shows a mating connector according to an exemplary embodiment.

FIG. 18 shows a mating connector 34 consistent with embodiments of the disclosure. The part of the mating connector 34 at the cable outlet side is not shown so as not to obstruct the view of an accommodation means 39. The mating connector 34 has four openings 35 for mating contact connector elements, which are to engage in the contact connector elements 12 of the connector 33. In addition, the mating connector 34 has a mating connector ramp 36, which in a connecting axis 37 of the mating connector 34 shown in FIG. 19 is at an angle of 30 to 45 degrees.

Figure 19:
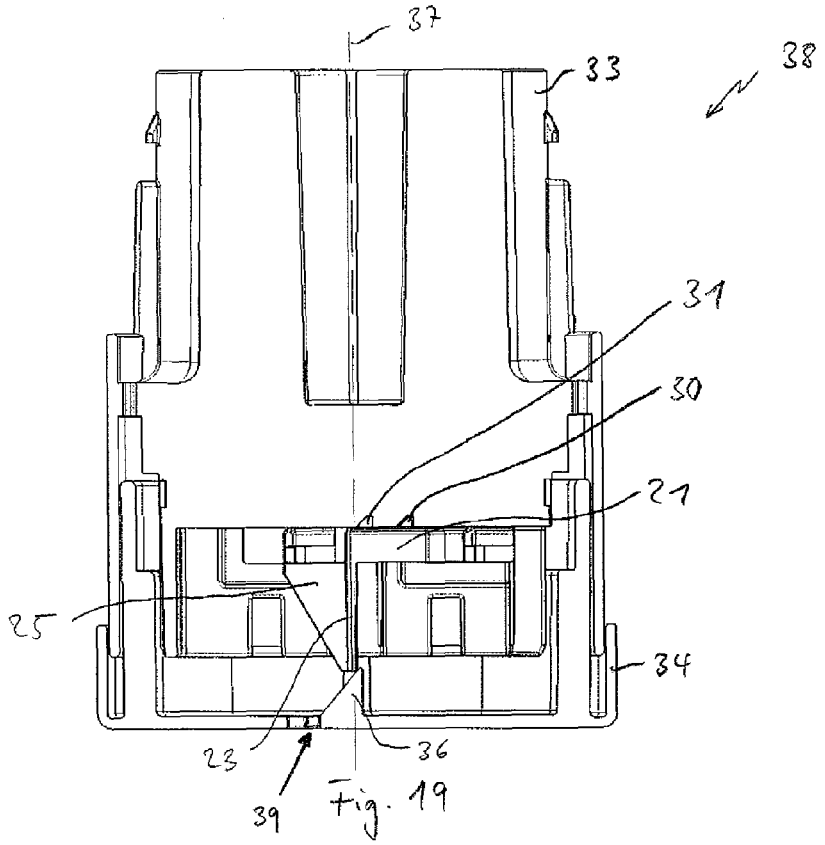
FIG. 19 is a cross-sectional view of an arrangement according to an exemplary embodiment with a connector and the mating connector in FIG. 18 when the connector and the mating connector are being connected.
Figure 20:
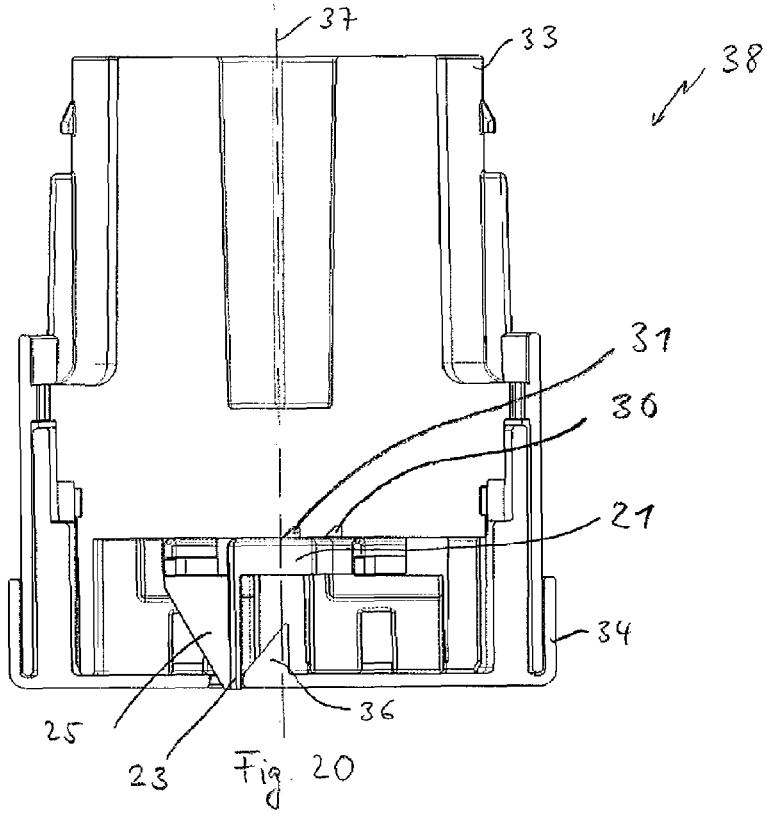
FIG. 20 shows the arrangement in FIG. 19 in a cross-sectional view, with the connector being connected to the mating connector.

FIGS. 19 and 20 are cross-sectional views showing an arrangement 38 consistent with embodiments of the disclosure, of the connector 33 and the mating connector 34. FIGS. 19 and 20 illustrate the function of the mating connector ramp 36. In FIG. 19, the secondary locking member 21 is in the pre-locking position so that the detent latch 28 engages in the pre-locking groove 30. The manipulation element 23 of the secondary locking member 21, which is supported by the reinforcing element 25, touches the mating connector ramp 36 at its beginning and slides along the mating connector ramp 36 as the connector 33 is being connected to the mating connector 34, thus moving the secondary locking member 21 into the direction of its final-locking position.

As shown in FIG. 20, the manipulation element 23 of the secondary locking member 21 engages in the accommodation means 39 once it has completed travel along the mating connector ramp 36, and the detent latch 28 of the secondary locking member 21 latches into the final-locking groove 31. As such, the secondary locking member 21 is always secured in its final-locking position with secondary locking member.

Figure 21:
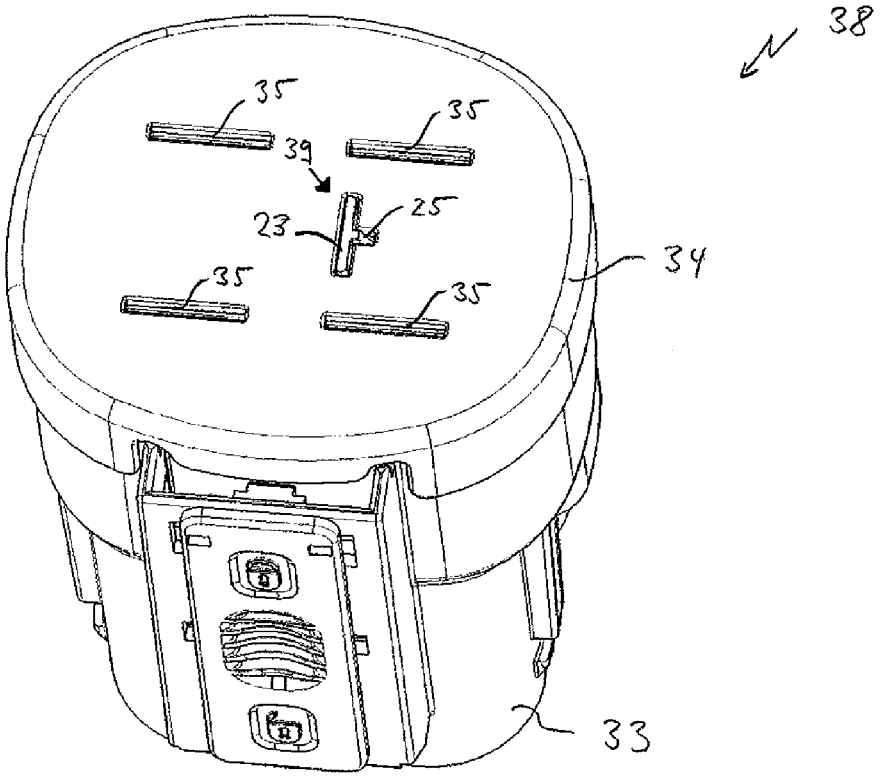
FIG. 21 shows the arrangement in FIG. 20 in a perspective view diagonally from above against a connecting direction of the connector.

FIG. 21 shows the arrangement 38 of the connector 33 and the mating connector 34 in a perspective view against a connecting direction of the connector 33 diagonally from above. The connector 33 is completely inserted into the mating connector 34 so that a part of the manipulation element 23 and the reinforcing element 25 of the secondary locking member 21 are visible through the accommodation means 39. In this case, the accommodation means 39 is developed as a slot with an essentially perpendicular lateral side slot.

Other embodiments of the disclosure will be apparent to those skilled in the art from consideration of the specification and practice of the invention disclosed herein. It is intended that the specification and examples be considered as exemplary only, with a true scope and spirit of the invention being indicated by the following claims.

LIST OF REFERENCE SYMBOLS

1 Connector
2 Front face
3 Section
4 Contact chamber
5 Protrusion
6 Housing
7 Secondary locking member
8 Detent latch
9 Pre-locking groove
10 Final-locking groove
11 Opening
12 Contact connector element
13 Metal sheet
14 Side wall
15 Latching arm
16 Tab
17 Front face
18 Lamellae
19 Contact plate
20 Recess
21 Secondary locking member according to an exemplary embodiment
22 Main body
23 Manipulation element
24 Locking arm
25 Reinforcing element
26 Ramp
27 Slope
28 Detent latch
29 Housing
30 Pre-locking groove
31 Final-locking groove
32*a* Assembly guide rail
32*b* Locking guide rail
33 Connector according to an exemplary embodiment
34 Mating connector according to an exemplary embodiment
35 Openings for mating contact connector elements
36 Mating connector ramp
37 Connecting axis of the mating connector
38 Arrangement of a connector and a mating connector according to an exemplary embodiment
39 Accommodation means

What is claimed is:

1. An electrical connector configured to be electrically coupled to a mating connector, the connector comprising:
- a housing having a contact chamber;
- a contact connector element, accommodated in the contact chamber and configured to be coupled to the mating connector, the contact connector element includes a latching arm configured to latch with the contact chamber; and
- a secondary locking member configured to frictionally lock the contact connector element in the housing, the secondary locking member including a ramp configured to press against a first side wall of the contact connector element when the secondary locking member is inserted into the housing, such that a second side wall of the contact connector element is pressed against the housing.

2. The connector according to claim 1, wherein the ramp has an incline of 0.1 to 10 degrees.

3. The connector according to claim 2, wherein the incline is between 3 and 5 degrees.

4. The connector according to claim 1, wherein the secondary locking member is further configured to lock the contact connector element in the housing with a positive locking.

5. The connector according to claim 4, wherein:
- the contact connector element includes a protrusion, and
- the secondary locking member includes a locking arm configured to move under the protrusion when the secondary locking member is being inserted into the housing to form the positive locking with the protrusion against a connecting direction of the connector.

6. The connector according to claim 5, wherein the locking arm includes a slope configured to slide under the protrusion when the secondary locking member is being closed and press a front face of the contact connector element against the housing.

7. The connector according to claim 6, wherein the slope has an incline of 0.1 to 10 degrees.

8. The connector according to claim 7, wherein the incline is between 3 and 5 degrees.

9. The connector according to claim 1, wherein:
- the housing includes a pre-latching groove and a final latching groove, and
- the secondary locking member includes a detent latch configured to:
  - engage in the pre-latching groove when the secondary locking member is in a pre-latching position, and
  - engage in the final latching groove when the secondary locking member is in a final latching position.

10. The connector according to claim 1, wherein the housing has a plurality of contact chambers accommodating a plurality of contact connector elements that are interlocked in the housing by the secondary locking member.

11. The connector according to claim 10, wherein the secondary locking member is configured to slide between the contact connector elements to press side walls of the contact connector elements against the housing.

12. The connector according to claim 10, wherein the secondary locking member includes a plurality of locking arms configured to lock the contact connector elements.

13. The connector according to claim 1, wherein the secondary locking member includes:
- a main body;
- a reinforcing element connected to the main body;
- a manipulation element extending from the main body and supported by the reinforcing element; and
- a locking arm extending from the main body and configured to lock the contact connector element, the locking arm includes the ramp.

14. A device comprising:
- a connector including:
  - a housing having a contact chamber;
  - a contact connector element accommodated in the contact chamber; and
  - a secondary locking member configured to frictionally lock the contact connector element in the housing, the secondary locking member including a ramp configured to press against a first side wall of the contact connector element when the secondary locking member is inserted into the housing, such that a second side wall of the contact connector element is pressed against the housing; and a mating connector including:

a mating connector element configured to electrically connect to the contact connector element; and a mating connector ramp configured to allow the secondary locking member to slide along the mating connector ramp as the connector is being connected to the mating connector and to move into a final latching position.

15. The device according to claim 14, wherein the mating connector ramp is positioned relative to a connecting axis of the mating connector at an angle of 10 to 70 degrees.

16. The device according to claim 15, wherein the angle is 30 to 45 degrees.

17. The device according to claim 15, wherein the mating connector includes an accommodation means configured to accommodate at least a part of the secondary locking member to secure the secondary locking member in the final latching position when the connector is connected to the mating connector.

* * * * *